US006902803B2

(12) United States Patent
Rim et al.

(10) Patent No.: US 6,902,803 B2
(45) Date of Patent: Jun. 7, 2005

(54) DIMENSIONALLY STABLE YARNS

(75) Inventors: Peter B. Rim, Midlothian, VA (US); Qiang Zhou, Midlothian, VA (US); Richard H. Woodlee, Midlothian, VA (US); Michael F. Kopplin, Esch Sur Alzette (LU)

(73) Assignee: Performance Fibers, Inc., Moncure, NC (US)

( * ) Notice: Subject to any disclaimer, the term of this patent is extended or adjusted under 35 U.S.C. 154(b) by 0 days.

(21) Appl. No.: 10/680,586

(22) Filed: Oct. 6, 2003

(65) Prior Publication Data

US 2005/0074607 A1 Apr. 7, 2005

(51) Int. Cl.[7] ..... D01F 6/00
(52) U.S. Cl. ..... 428/364; 428/395
(58) Field of Search ..... 428/364, 395

(56) References Cited

U.S. PATENT DOCUMENTS

| | | | | |
|---|---|---|---|---|
| 4,101,525 | A | 7/1978 | Davis et al. | 528/308.2 |
| 4,415,726 | A | 11/1983 | Tanji et al. | 528/272 |
| 4,491,657 | A | 1/1985 | Saito et al. | 528/308.1 |
| 5,397,527 | A | 3/1995 | Rim et al. | 264/210.8 |
| 5,403,659 | A | 4/1995 | Nelson et al. | 428/364 |
| 5,630,976 | A | 5/1997 | Nelson et al. | 264/210.8 |
| 6,403,006 | B1 | 6/2002 | Nelson et al. | 264/210.8 |
| 6,620,504 | B2 * | 9/2003 | Mizumura et al. | 428/357 |
| 2002/0187344 | A1 | 12/2002 | Nelson et al. | 428/364 |

FOREIGN PATENT DOCUMENTS

| | | |
|---|---|---|
| EP | 0456 496 | 11/1991 |
| JP | 1148808 | 6/1989 |

* cited by examiner

*Primary Examiner*—N. Edwards
(74) *Attorney, Agent, or Firm*—Rutan & Tucker

(57) ABSTRACT

An undrawn yarn is produced at increased quench delay and increased take-up speed to achieve improved ultimate elongation at a given crystallinity. Particularly preferred aspects include products comprising such yarns and methods for producing same.

9 Claims, 1 Drawing Sheet

DIMENSIONALLY STABLE YARNS

FIELD OF THE INVENTION

The field of the invention is dimensionally stable yarns and products incorporating same, as well as methods and apparatus for producing such dimensionally stable yarns.

BACKGROUND OF THE INVENTION

Significant improvements in fiber materials and spinning processes allowed spinning of multifilament yarns with high initial modulus and low shrinkage, and numerous processes and compositions have been developed in recent decades.

For example, Davis et al. describe in U.S. Pat. No. 4,101,525 a spinning process in which a dimensionally stable industrial strength multifilament polyester yarn is formed by extruding PET-containing polyester filaments using a solidification zone almost immediately after the spinneret under high spin-line stress to achieve almost immediate solidification of the filaments to produce yarns with relatively high birefringence. The so formed undrawn yarn is then drawn and further processed. Such processes generally allow formation of dimensionally stable yarns, however, present various difficulties in their formation. Most significantly, as the crystallinity increases, drawability of the yarns often significantly deteriorates.

In another example, Saito et al. describe in U.S. Pat. No. 4,491,657 formation of a dimensionally stable polyester yarn, in which the filaments are subjected to a heating zone operated at about the melting point of the polymer followed by a rapid cooling zone. The so formed filaments are then drawn and twisted into cords with relatively desirable properties. However, in most practical applications Saito's process is generally limited to yarns with relatively low terminal modulus, especially where the dimensionally stable yarn is further processed into a treated cord.

To overcome at least some of the disadvantages associated with the production of dimensionally stable yarns, polymeric filaments may be spun under high stress conditions to form an undrawn yarn that has crystallinity of 3 to 15 percent and a melting point elevation of 2 to 10 degrees Centigrade as described in U.S. Pat. No. 5,403,659 or U.S. Pat. No. 6,403,006 to Nelson et al. Alternatively, modified process conditions (e.g., using quench delay plus rapid cool to form a yarn with crystallinity of 3 to 13% and a melting point elevation of 2 to 10 degrees Centigrade) may be employed in a process of making dimensionally stable polyester yarn for high tenacity treated cords as described in U.S. Pat. No. 5,630,976 to Nelson et al.

Similarly, Rim et al describe in U.S. Pat. No. 5,397,527 a process for production of dimensionally stable yarns using quench delay plus rapid cool to form a partially oriented yarn of birefringence of at least 0.030, which is then hot-drawn to a drawn dimensionally stable yarn. However, while such processes typically improve various properties of undrawn yarns, drawing such yarns frequently remains problematic, especially where crystallinity of such yarns is relatively high.

Thus, although there are numerous processes for production of dimensionally stable undrawn yarns known in the art, all or almost all of them suffer from various disadvantages. Therefore, there is still a need to provide improved yarns and processes, especially where such yarns are dimensionally stable.

SUMMARY OF THE INVENTION

The present invention is directed to dimensionally stable undrawn yarns, methods for producing such yarns, and products incorporating same. More specifically, the inventors unexpectedly discovered that undrawn yarns exhibit increased ultimate elongation when the yarn is spun using delayed quenching at increased take-up speed.

Therefore, in one aspect of the inventive subject matter, a method of producing an undrawn yarn having a predetermined crystallinity will include one step in which a molten polymer (e.g., poly(ethylene terephthalate)) is extruded through a spinneret plate to form a plurality of filaments. In another step, the plurality of filaments are passed through a heated sleeve to thereby provide a quench delay, and the plurality of filaments are taken up at a take-up speed, wherein the quench delay and the take-up speed are selected such that an ultimate elongation of the undrawn yarn increases at the predetermined crystallinity when the quench delay increases.

In especially preferred aspects, the predetermined crystallinity is between 10% and 40%, and the undrawn yarn has a linear density of at least 700 dtex. Furthermore, it is generally preferred that the quench delay in the heated sleeve is increased by increasing a length of the heated sleeve (e.g., from 200 mm to at least 300 mm, or even longer). Alternatively, the quench delay in the heated sleeve may also be increased by increasing the temperature in the heated sleeve. With respect to the take-up speed it is generally preferred that the take-up speed for the plurality of filaments is at least 3000 m/min.

In a further aspect of the inventive subject matter, a method of producing an undrawn yarn may include one step in which a molten polymer (preferably a polyester) is extruded through a spinneret plate to form a plurality of filaments. In another step, quenching of the plurality of filaments is delayed in a heated sleeve, and in yet another step, the plurality of filaments are taken up at a take-up speed TU (m/min) using a quench delay such that the crystallinity of the undrawn yarn is less than $0.017 \times TU - 39$. Such produced yarns preferably have a linear density of at least 300 dtex.

It is further preferred that in such methods the heated sleeve has a length of at least 300 mm and that the temperature in the heated sleeve is 250° C. or higher. Additionally, or optionally, preferred take-up speeds will generally be in the range of between 3000 m/min and 5000 m/min. Yarns produced using such processes may then be drawn to form a drawn yarn, which may be further modified with an overfinish, and which may further be at least partially embedded into a rubber-containing composition.

Thus, in still another aspect of the inventive subject matter, an undrawn delayed-quenched dimensionally stable polyester yarn will have a crystallinity C, and an ultimate elongation UE, wherein $UE \geqq -1.6*C+121$. Particularly preferred yarns will be fabricated from poly(ethylene terephthalate) and will have a crystallinity between 10% and 40% (typically at a linear density between 700 and 6000 dtex). Of course, it should be recognized that such yarns may further be drawn to form a drawn dimensionally stable yarn, which may then be employed as a component in a product, wherein especially contemplated products include power transmission belts, conveyor belts, automobile tires, safety belts, parachute harnesses, parachute lines, cargo handling nets, and safety nets.

In a still further aspect of the inventive subject matter, an apparatus comprises a spinneret plate that is operationally coupled to an extruder and metering pump that provides a molten polymer to the spinneret plate, wherein the spinneret plate produces a plurality of filaments from the molten polymer. A heated sleeve receives the plurality of filaments, thereby delaying quenching at a predetermined quench delay, and a take-up roll takes up the plurality of filaments at a take-up speed, wherein the take-up speed and the heated sleeve are configured to operate at a condition in which ultimate elongation of a yarn having a predetermined crystallinity increases when the predetermined quench delay increases. The polymer used in such apparatus will preferably comprise a polyester, and the spinneret plate preferably comprises at least 50 orifices that produce the plurality of filaments. The heated sleeve in further preferred apparatus will have a length of at least 300 mm and has a temperature of 250° C. or higher, while the take-up speed is between 3000 m/min and 5000 m/min.

Various objects, features, aspects and advantages of the present invention will become more apparent from the following detailed description of preferred embodiments of the invention, along with the accompanying drawings.

DETAILED DESCRIPTION

The inventors surprisingly discovered that undrawn dimensionally stable polymeric yarns with improved ultimate elongation over comparable yarns at the same crystallinity can be produced in a process in which the filaments after extrusion are subjected to a quench delay and taken up at increased take-up speed.

Figure 1:
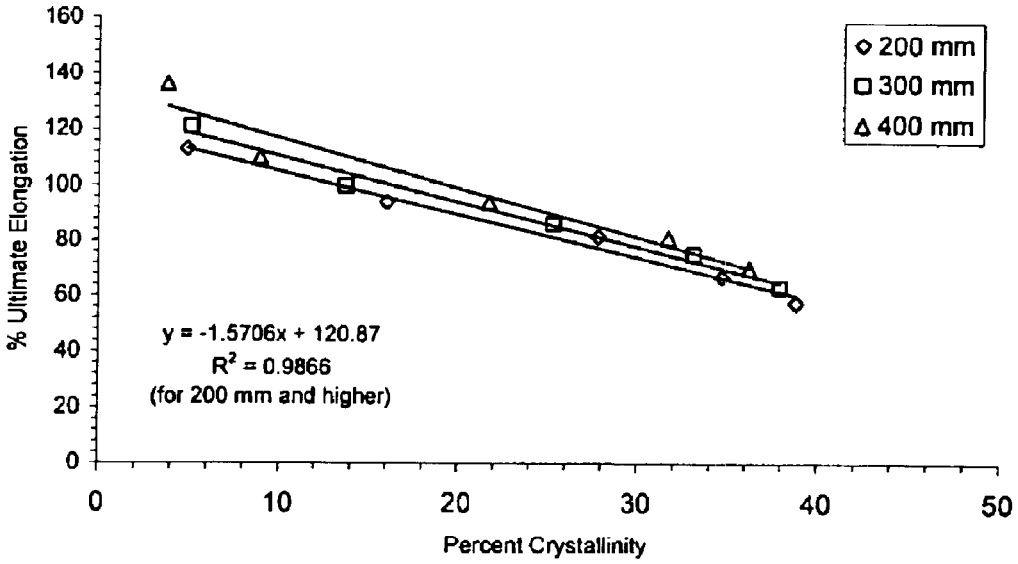
FIG. 1 is a graph representing an interrelationship between ultimate elongation and crystallinity of an undrawn exemplary yarn, wherein the yarn is spun using selected quench delays according to the inventive subject matter.

It is generally recognized that increasing crystallinity of undrawn yarns will generally result in improved dimensional stability of the corresponding drawn yarns and treated cords produced from such yarns. Unfortunately, as crystallinity of a yarn increases, drawing or stretching of the yarn becomes more and more problematic (i.e., ultimate elongation dramatically decreases with increasing crystallinity). It is also well known in the art that increasing quench delay will typically result in yarns with lower crystallinity as the spin line stress is reduced. However, the inventors unexpectedly discovered that when the ultimate elongation of a plurality of yarns having the same crystallinity was plotted as a function of quench delay (e.g., effected by elongation of the heated sleeve), ultimate elongation of such yarns surprisingly increases with increased quench delay (where the yarns are compared at the same crystallinity). A graphical representation of this observation is depicted in FIG. 1, where each regression line represents data points of an undrawn yarn produced using a heated sleeve of a length as indicated in the legend. Using this graph, it becomes immediately apparent that ultimate elongation of such yarns with the same crystallinity is a function of quench delay.

The undrawn dimensionally stable yarns of FIG. 1 were produced using production parameters as listed in table 1 below. In this example, the yarn was spun using a 125 hole spinneret, with polyethylene terephthalate chip having an intrinsic viscosity (IV) of 1.0 and a diethylene glycol content (% DEG) of 1.1 as the polymer. It has been observed that the polymer type can have an influence on the ultimate elongation, independent of other variables. Extrusion rate was approximately 46.2 kg/hr, and crystallinity, ultimate elongation, and linear density was determined as in the experimental section described below. Quench air temperature was 20 degrees centigrade.

TABLE 1

| Sleeve Length (mm) | Take-up Speed (m/min) | Sleeve Temp. (° C.) | Quench Rate (m/s) | Crystallinity (%) | Ultimate Elongation (%) | Denier (dtex) |
|---|---|---|---|---|---|---|
| 200 | 3000 | 280 | 0.8 | 4.9 | 112.9 | 2357 |
| 200 | 3500 | 280 | 0.8 | 16 | 94.1 | 2110 |
| 200 | 4000 | 280 | 0.8 | 27.8 | 81.3 | 1888 |
| 200 | 4500 | 280 | 0.8 | 34.7 | 66.7 | 1639 |
| 200 | 5000 | 280 | 0.8 | 38.8 | 57.4 | 1536 |
| 300 | 3000 | 280 | 0.8 | 5.1 | 121 | 2674 |
| 300 | 3500 | 280 | 0.8 | 13.7 | 100 | 2293 |
| 300 | 4000 | 280 | 0.8 | 25.3 | 86 | 2006 |
| 300 | 4500 | 280 | 0.8 | 33.1 | 75 | 1786 |
| 300 | 5000 | 280 | 0.8 | 37.9 | 63 | 1613 |
| 400 | 3000 | 280 | 0.8 | 3.8 | 136 | 2636 |
| 400 | 3500 | 280 | 0.8 | 8.9 | 110 | 2251 |
| 400 | 4000 | 280 | 0.8 | 21.7 | 94 | 1968 |
| 400 | 4500 | 280 | 0.8 | 31.7 | 81 | 1740 |
| 400 | 5000 | 280 | 0.8 | 36.2 | 70 | 1572 |

To compare the interrelationship between crystallinity and take-up speed at a specific quench delay, the inventors prepared a comparative yarn (with similar yarn polymer properties made in a continuous polymerization and spinning step) using substantially identical process parameters, but a heated sleeve of only 102 mm length at temperatures between about 300–400 degrees centigrade. Further process conditions for the comparative yarn are listed in Table 2 below, and the results are graphically depicted in FIG. 2, in which crystallinity is expressed as a function of take-up speed at predetermined quench delays (here: effected by increasing sleeve lengths). Data points for the inventive examples are taken from table 1 above.

TABLE 2

| Take-up Speed (m/min) | Sleeve Temp. (° C.) | Quench Rate (in/water) | Crystallinity (%) |
|---|---|---|---|
| 2700 | 300 | 9 | 20.9 |
| 2500 | 300 | 15.5 | 22.8 |
| 2900 | 300 | 15.5 | 30.1 |
| 2700 | 300 | 22 | 28.6 |
| 2900 | 350 | 22 | 29.9 |
| 2500 | 350 | 22 | 21.1 |
| 2700 | 350 | 15.5 | 25.6 |
| 2900 | 350 | 9 | 27.4 |
| 2500 | 350 | 9 | 20.7 |
| 2700 | 400 | 9 | 17.9 |
| 2500 | 400 | 15.5 | 17.5 |
| 2900 | 400 | 15.5 | 27.5 |
| 2700 | 400 | 22 | 24.3 |

Of course, it should be recognized that the increase of ultimate elongation at a predetermined crystallinity by increasing quench delay is not limited to the specific conditions provided above, and it is generally contemplated that numerous modification may be made without departing from the inventive concept presented herein.

For example, it is contemplated that the polymer employed for the production of the undrawn yarns may vary considerably, and it is generally contemplated that all melt-extrudable polymers are suitable for use in conjunction with the teachings presented herein. However, it is generally preferred that polymer comprises a polyester. Therefore, particularly preferred polymers include a poly(alkylene terephthalate) (e.g., poly(ethylene terephthalate) (PET) or poly(butylene terephthalate)), a poly(alkylene naphthalate) (e.g., poly(ethylene naphthalate) (PEN) and poly(butylene naphthalate)), or a poly(cycloalkylene naphthalate). Further preferred polyesters also include copolymers and block-copolymers, wherein one component in the copolymer or block-copolymer is preferably PET or PEN, and wherein the other component comprises a glycol, a lactone, or other component.

Consequently, melting point, intrinsic viscosity, and diethylene glycol of suitable polymers may vary substantially, and it should be recognized that the particular melting point, IV, and DEG will at least in part depend on the particular polymer employed and manner in which the polymer has been produced/treated. However, it is generally preferred that where the polymer is or comprises a polyester, the melting point will be in the range of about 100 degrees centigrade to about 500 degrees centigrade, more preferably in the range of about 200 degrees centigrade to about 400 degrees centigrade, and most preferably in the range of about 230 degrees centigrade to about 300 degrees centigrade. Similarly, the IV will typically be in the range of about 0.5 to 2, and more typically in the range of between about 0.6 to 1.5, and most typically in the range of between about 0.8 to 1.2. (As measured according to U.S. Pat. No. 5,630,976).

With respect to the melting of the polymer, the extruder type, and the spinneret, it should be appreciated that the particular configuration will depend at least in part on the selected polymer, the desired number, shape, and physical properties of the filaments, and the desired linear density of the undrawn yarn. Therefore, the inventors contemplate that most if not all of the known spinning equipment may be employed that can be used for production of a dimensionally stable undrawn (or drawn) yarn. However, configurations and equipment as described above is generally preferred.

In further alternative aspects of the inventive subject matter, it is contemplated that the increased quench delay may not only be effected by increasing the length of the heated sleeve, but also additionally (or alternatively) by increasing the temperature within the heated sleeve and/or by modification of the quench rate. For example, where the length of the heated sleeve should be limited to a particular length, further increase of the quench delay may be achieved by increasing the temperature within the heated sleeve. In another less preferred example, quench delay may be modified by reducing the quench rate and extending the length of the heated sleeve, while in a still further example the quench delay may be increased by increasing the temperature (and optionally decreasing the quench rate).

Figure 2:
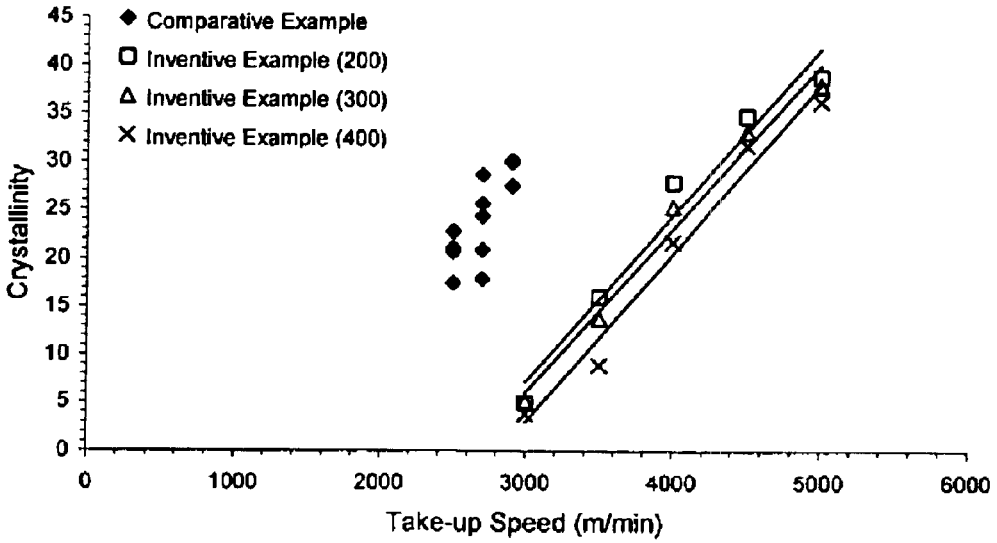
FIG. 2 is a graph representing an interrelationship between take-up speed and crystallinity of an undrawn exemplary yarn, wherein the yarn is spun using selected quench delays according to the inventive subject matter.

Of course, it should be appreciated that with increasing quench delay, the take-up speed of the plurality of filaments will need to be increased to maintain a particularly desirable degree in crystallinity. Viewed from another perspective, it should be recognized that at a given take-up speed crystallinity decreases when quench delay increases. FIG. 2 will provide a person of ordinary skill in the art with exemplary guidance to prepare undrawn yarns according to the inventive subject matter. Thus, and based on the data from table 1 above, the inventors discovered that contemplated yarns can be prepared at a take-up speed TU and quench delay such that the crystallinity of the undrawn yarn is less than $0.017 \times TU-39$, wherein the quench delay is preferably controlled by increasing the length of the heated sleeve.

Consequently, preferred take-up speeds will generally be in the range of between about 3000 m/min and 5000 m/min where the quench delay is provided in a heated sleeve having a length of about 200 mm to about 400 mm. However, where appropriate, lower take-up speeds (e.g., between about 2000 m/min and about 3000 m/min) are also considered suitable for use herein. Similarly, and especially where relatively high crystallinity is desired, take-up speeds of more than 5000 m/min (e.g., between about 5000 m/min and about 7000 m/min, or even higher) are contemplated.

Thus, it should be recognized that the ultimate elongation of an undrawn yarn can be increased by selecting a proper quench delay in combination with a particular take-up speed. Based on the data presented herein (and other data not shown), the inventors discovered that an undrawn delayed-quenched dimensionally stable polyester yarn with a crystallinity C and an ultimate elongation UE can be produced in which $UE \geqq -1.6*C+121$. As used herein, the term "delayed quenched" undrawn yarn refers to an undrawn yarn that has a greater UE as compared to a reference yarn, wherein the reference yarn is prepared using the same conditions as employed for the delayed quenched yarn with the exception that (a) the take-up speed for the reference yarn is lower than the take-up speed for the delayed quenched yarn, and (b) the reference yarn is quenched at a faster rate than the delayed quenched yarn.

As further used herein, the term "dimensionally stable" drawn yarn refers to yarns having a dimensional stability defined by $E_x$+TS of no more than 12, and more typically of no more than 11. Typically, first generation yarns have $E_x$+TS in the range of 11–12, and later improved versions are lower. Ex is the elongation at x stress for the yarn, where x is 41 cN/tex or, for example, 45 N for an 1100 decitex yarn, 58 N for a 1440 decitex yarn, 67 N for a 1650 decitex yarn, and 89 N for a 2200 dtex yarn. TS is thermal shrinkage, which can be determined using a Testrite (Model NK5) instrument with the following procedure: To one end of the sample, a weight equal to ((decitex)×0.05 g) is attached, and the sample is transferred into the instrument at the desired temperature for 120 sec. Dimensional stability is expressed as the sum of the elongation at x N and thermal shrinkage at 177° C. for the tested yarn.

It is generally preferred that contemplated undrawn yarns will have a linear density of at least 300 dtex, more preferably of at least 500 dtex, and most preferably of at least 700 dtex. In further preferred aspects of the inventive subject matter, it is contemplated that the undrawn yarns may be drawn to form a drawn dimensionally stable yarn. Drawing/stretching may be performed on-line with the spinning process, or in a separate drawing/stretching step. Suitable apparatus for drawing contemplated yarn is well known in the art, and it is generally contemplated that all of the known drawing methods are suitable for use herein. Contemplated draw ratios will at least in part depend on the particular use for the drawn yarn, and it should therefore be recognized that numerous draw ratios are contemplated. However, suitable draw ratios will generally be in the range of between about 1.01/1.0 to about 3.5/1.0. As also used herein, the term "about" in conjunction with a numeric value is employed to broaden the numeric value to a range that spans 10% absolute and inclusive around that numeric value. For example, the term "about 10%" refers to a range of 9% a (inclusive) to 11% (inclusive).

Furthermore, drawn and undrawn yarns according to the inventive subject matter may further be processed (e.g., an overfinish may be added), and the optionally processed yarn may then be formed or incorporated into a product. For example, the yarn may be twisted, corded, or woven, which may then be used following conventional processes in the manufacture of various products (e.g., safety belts, parachute harnesses, parachute lines, cargo handling nets, or safety nets). Further particularly preferred products include rubber-containing products into which the yarn or yarn product is at least partially embedded. Therefore, such products include power transmission belts, conveyor belts, and automobile tires.

Consequently, the inventors contemplate a method in which an undrawn yarn having a predetermined crystallinity is produced. In one step of such a method, a molten polymer is extruded through a spinneret plate to form a plurality of filaments. In another step, the plurality of filaments is passed through a heated sleeve to thereby provide a quench delay, and the plurality of filaments are then taken up at a take-up speed, wherein the quench delay and the take-up speed are selected such that an ultimate elongation of the undrawn yarn increases at the predetermined crystallinity when the quench delay increases.

While not limiting to the inventive subject matter, it is generally preferred that the predetermined crystallinity will be in the range of between about 10% and about 40%. Such undrawn yarns will preferably have a linear density of at least 300 dtex, and more preferably at least 500 dtex. However, where desired, lower crystallinity (e.g., between about 2% and 10%) is also deemed suitable. Similarly, and especially where relatively high dimensional stability is desired crystallinity of more than 40% (typically between about 40% and about 55%, and even higher) is also contemplated.

Therefore, it should be recognized that a method of producing an undrawn yarn, may have one step in which a molten polymer is extruded through a spinneret plate to form a plurality of filaments. In another step, quenching of the plurality of filaments is delayed in a heated sleeve, and the plurality of filaments are taken up at a take-up speed TU (m/min) using a quench delay such that the crystallinity of the undrawn yarn is less than $0.017 \times TU-39$.

As already addressed above, it is generally preferred in such methods to increase the quench delay by increasing the length of the heated sleeve (e.g., from 100 mm or 200 mm to at least about 300 mm, and more preferably at least about 400 mm) and to employ take-up speed of at least about 3000 m/min to about 5000 m/min. Most preferably, the polymer comprises a polyester (e.g., PET, or PET copolymer), and the temperature in the heated sleeve is at least 250° C. or higher.

Thus, it should be recognized that undrawn delayed-quenched dimensionally stable polyester yarns (most preferably comprising PET) may be produced having a crystallinity C, and an ultimate elongation UE, wherein $UE \geqq -1.6*C+121$. Especially preferred delayed-quenched dimensionally stable polyester yarns will exhibit crystallinity between about 10% and about 40%, and may have a linear density of between about 700 and about 6000 dtex. As already discussed above, such yarns may further be drawn/stretched to form a drawn dimensionally stable yarn, which may then be incorporated or formed into a product.

Moreover, the inventors contemplate that the yarns according to the inventive subject matter may be prepared using an apparatus that includes a spinneret plate that is operationally coupled to an extruder and metering pump that provides a molten polymer to the spinneret plate, wherein the spinneret plate (e.g., with at least 50 orifices) produces a plurality of filaments from the molten polymer. A heated sleeve is coupled to the apparatus and receives the plurality of filaments, thereby delaying quenching at a predetermined quench delay, and a take-up roll takes up the plurality of filaments at a take-up speed, wherein the take-up speed and the heated sleeve are configured to operate at a condition in which ultimate elongation of a yarn having a predetermined crystallinity increases when the predetermined quench delay increases.

Experiments

Ultimate elongation was determined with a Statimat M Tester with 500 mm length, 500 mm/min test speed, and 0.50 cN/tex pre-tension.

Percent crystallinity was determined from density data using the equation: percent crystallinity=[(density−1.335)/0.12](1.455/density)(100).

Density was determined at 23° C. using a carbon tetrachloride/n-heptane density gradient column according to ASTM DI 505 by comparing the position of the sample with glass bead standards of known density. Five specimens (~1 cm in length) were prepared for each sample tested using a single filament from the sample to tie and hold the filaments together. The specimens were wetted by placing in a mixture of carbon tetrachloride/n-heptane in a flask and degassed by applying a vacuum for ~10 seconds. The specimens were immediately placed in the density gradient column using long-handled tongs and the positions of specimens and glass bead standards recorded after 2.0 hours.

Linear density was determined by reeling 100 meters of yarn on a 1 meter reel. Yarn weight was then determined by an analytical balance, and dtex was calculated as:

$$dtex = \text{weight}(g) \times 100$$

Thus, specific embodiments and applications of improved dimensionally stable yarns have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

What is claimed is:

1. An undrawn dimensionally stable polyester yarn having a dimensional stability of no more than 12 as defined by Ex+TS, having a crystallinity C, and an ultimate elongation UE, wherein $UE \geqq 1.6*C+121$.

2. The undrawn dimensionally stable polyester yarn of claim 1 wherein the polyester comprises poly(ethylene terephthalate).

3. The undrawn yarn of claim 1 wherein the crystallinity is between 10% and 40%.

4. The undrawn yarn is claim 3 wherein the linear density is between 300 and 6000 dtex.

5. A drawn dimensionally stable yarn formed from the undrawn dimensionally stable polyester yarn of claim 1.

6. A product comprising the drawn dimensionally stable yarn of claim 5.

7. The product of claim 6, wherein the product is selected from the group consisting of a power transmission belt, a conveyor belt, an automobile tire, a safety belt, a parachute harness, a parachute line, a cargo handling net, and a safety net.

8. The undrawn dimensionally stable polyester yarn of claim 1, wherein the yarn is a delayed quenched yarn.

9. A drawn dimensionally stable yarn formed from the undrawn dimensionally stable polyester yarn of claim 8.

* * * * *